US010152908B2

(12) United States Patent
Pyeon et al.

(10) Patent No.: US 10,152,908 B2
(45) Date of Patent: Dec. 11, 2018

(54) TIMING CONTROLLER, DISPLAY DEVICE, AND METHOD OF DRIVING THE SAME

(71) Applicant: LG DISPLAY CO., LTD., Seoul (KR)

(72) Inventors: MyungJin Pyeon, Paju-si (KR); HyunSon Chon, Seoul (KR)

(73) Assignee: LG Display Co., Ltd., Seoul (KR)

( * ) Notice: Subject to any disclaimer, the term of this patent is extended or adjusted under 35 U.S.C. 154(b) by 26 days.

(21) Appl. No.: 14/850,626

(22) Filed: Sep. 10, 2015

(65) Prior Publication Data

US 2016/0125787 A1 May 5, 2016

(30) Foreign Application Priority Data

Nov. 3, 2014 (KR) ..... 10-2014-0150889

(51) Int. Cl.
*G09G 3/20* (2006.01)
*G09G 3/3233* (2016.01)

(52) U.S. Cl.
CPC ..... *G09G 3/2022* (2013.01); *G09G 3/2055* (2013.01); *G09G 3/3233* (2013.01); *G09G 2300/0842* (2013.01); *G09G 2320/0233* (2013.01); *G09G 2320/0295* (2013.01)

(58) Field of Classification Search
CPC .. G09G 3/3648; G09G 3/2051; G09G 3/2055; G09G 3/32; G09G 5/00; G09G 3/003; G09G 2320/0252; G09G 2320/028; G09G 3/2077; G09G 3/006; G09G 3/2092; G09G 3/2044; G09G 3/2022; G09G 3/3233; G09G 2300/0842; G09G 2320/0233; G09G 2320/0295
See application file for complete search history.

(56) References Cited

U.S. PATENT DOCUMENTS

2006/0125749 A1* 6/2006 Lee ..... G09G 3/3648 345/88
2007/0057975 A1* 3/2007 Oh ..... G09G 3/3648 345/690
2007/0229420 A1* 10/2007 Hwang ..... G09G 3/006 345/87
2007/0297690 A1* 12/2007 Yu ..... G06T 5/009 382/274
2008/0049051 A1* 2/2008 Han ..... G09G 3/006 345/690
2010/0060660 A1* 3/2010 Bae ..... G09G 3/2055 345/596
2010/0165222 A1* 7/2010 Choi ..... G09G 3/3648 349/15
2010/0309234 A1* 12/2010 Lee ..... G09G 3/3607 345/690
2011/0216056 A1* 9/2011 Yoo ..... G09G 3/32 345/212
2012/0069061 A1* 3/2012 Kim ..... G09G 3/3648 345/690
2016/0117973 A1* 4/2016 Lee ..... G09G 3/2051 345/691

* cited by examiner

*Primary Examiner* — Robert Michaud
(74) *Attorney, Agent, or Firm* — Fenwick & West LLP

(57) ABSTRACT

A timing controller, a display device, and a method of driving the same able to prevent a dark defect that would otherwise be formed when two or more image control methods are disclosed.

20 Claims, 16 Drawing Sheets

TIMING CONTROLLER, DISPLAY DEVICE, AND METHOD OF DRIVING THE SAME

CROSS REFERENCE TO RELATED APPLICATION

This application claims priority from and the benefit under 35 U.S.C. § 119(a) of Korean Patent Application Number 10-2014-0150889 filed on Nov. 3, 2014, which is hereby incorporated by reference for all purposes as if fully set forth herein.

BACKGROUND

Related Field

The present disclosure relates to a timing controller, a display device, and a method of driving the same.

Description of Related Art

In response to the development of the information society, there has been increasing demand for various types of display devices able to display images. Various display devices, such as liquid crystal display (LCD) devices, plasma display panels (PDPs), and organic light-emitting diode (OLED) display devices, are in common use.

On a display panel, an image unit having a size greater than a single pixel may be formed by defective pixels having vague boundaries, or a Mura (also referred to as a stain) may be formed due to non-uniform screen characteristics. Therefore, image control technology for compensating for such a stain through data compensation or the like has been proposed.

As another example of image control technology, dithering control technology for expressing a greater number of grayscale levels than the number of grayscale levels able to be expressed by a source driver integrated circuit (IC) has been proposed.

When such image control technologies, including the image control technology for compensating for a stain and the dithering control technology, are applied, an unexpected dark defect may be formed on the display panel.

Such an unexpected dark defect may occur, even if no defects typically causing a dark defect are present on the display panel.

SUMMARY

A timing controller, a display device, and a method of driving the same able to prevent a dark defect that would otherwise be formed when two or more image control methods are applied are disclosed.

One or more embodiments relate to a timing controller, a display device, and a method of driving the same able to prevent a dark defect due to pixel failure that would otherwise accidently occur when a stain compensation control operation and a dithering control operation are performed in a combined manner.

One or more embodiments relates to a timing controller, a display device, and a method of driving the same able to prevent a dark defect due to pixel failure that would otherwise accidently occur when a stain compensation control operation, a dithering control operation, and a threshold voltage compensation control operation are performed in a combined manner.

In one aspect, a timing controller includes: first compensation controller configured to generate first compensated image data by adding a first compensation value to image data; and a variable dithering controller. The variable dithering controller is configured to output the first compensated image data responsive to the first compensated image data being equal to or smaller than a maximum grayscale level, and configured to generate modified first compensated image data by modifying the first compensated image data such that the modified first compensated image data is equal to or smaller than the maximum grayscale level responsive to the first compensated image data being greater than the maximum grayscale level.

In one aspect, a method of driving a display device includes: generating first compensated image data by adding a first compensation value to image data; outputting the first compensated image data responsive to the first compensated image data being smaller than or equal to a maximum grayscale level; and generating modified first compensated image data by modifying the first compensated image data such that the modified first compensated image data is equal to or smaller than the maximum grayscale level responsive to the first compensated image data being greater than the maximum grayscale level.

In one aspect, a display device includes: a display panel including data lines, gate lines, and a matrix of subpixels disposed thereon; a timing controller configured to output image data by modifying the image data based on a piece of variable dithering control data among a plurality of pieces of variable dithering control data variously defining compensation values about grayscale levels; and a data driver electrically connected to the timing controller and the data lines, the data driver configured to receive the modified image data, convert the received image data to data voltages, and output the data voltages to the data lines.

In one aspect, a display device includes: a display panel including data lines, gate lines, a matrix of subpixels disposed thereon; a timing controller configured to output image data by compensating for the image data; and a data driver electrically connected to the timing controller and the data lines, the data driver configured to convert image data output by the timing controller into data voltages and to output the data voltages to the data lines. Subpixels to which the data voltages are applied form no dark defect when the image data correspond to a maximum grayscale level.

According to present embodiments, it is possible to provide the timing controller, the display device, and the method of driving the same able to prevent a dark defect that would otherwise occur when two or more image control technologies are applied.

In addition, according to present embodiments, it is possible to provide the timing controller, the display device, and the method of driving the same able to prevent a dark defect due to unexpected pixel failure when the stain compensation control operation and the dithering control operation are performed in a combined manner.

Furthermore, according to present embodiments, it is possible to provide the timing controller, the display device 100, and the method of driving the same able to prevent a dark defect due to unexpected pixel failure when the stain compensation control operation, the dithering control operation, and the threshold voltage compensation control operation are performed in a combined manner.

BRIEF DESCRIPTION OF THE DRAWINGS

The above and other objects, features and advantages of various embodiments disclosed herein will be more clearly understood from the following detailed description when taken in conjunction with the accompanying drawings, in which.

DETAILED DESCRIPTION

Figure 1:
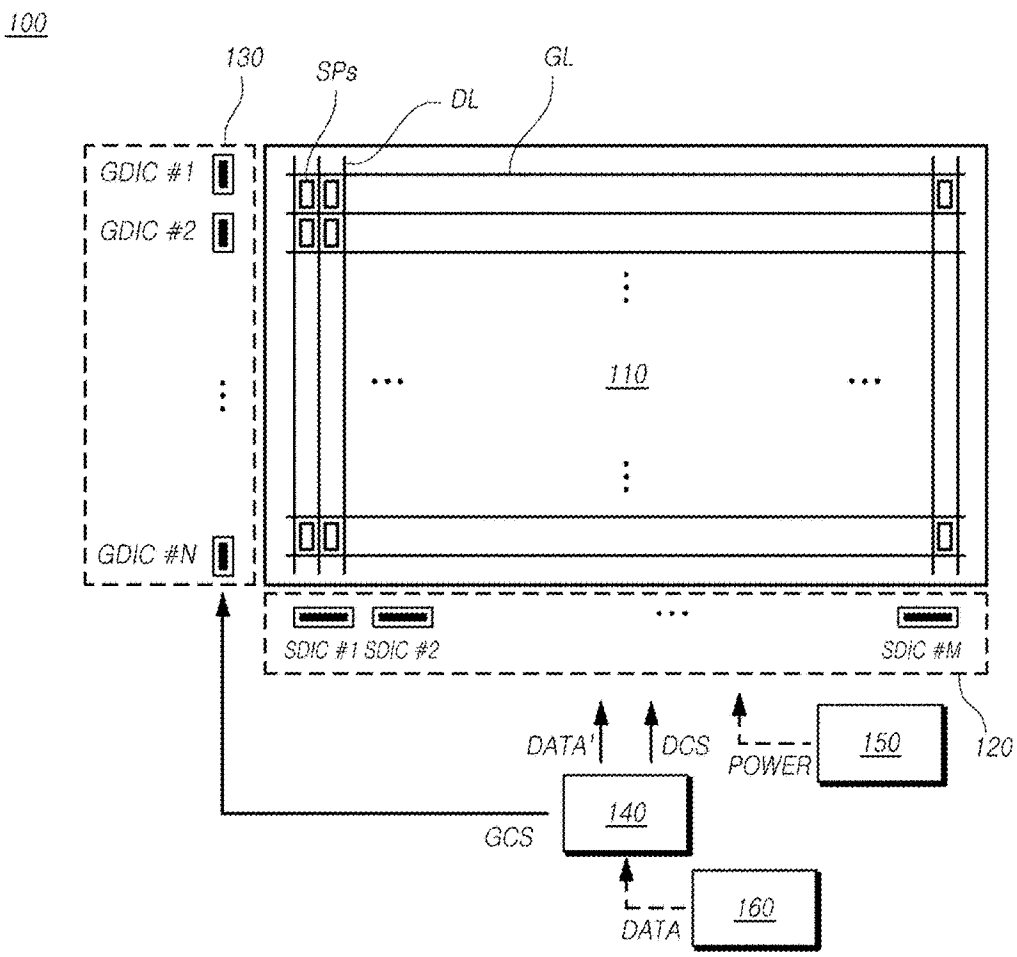
FIG. 1 is a configuration view illustrating a display device according to present embodiments.

Reference will now be made in detail to various embodiments, examples of which are illustrated in the accompanying drawings. Throughout this document, reference should be made to the drawings, in which the same reference numerals and signs will be used to designate the same or like components. In the following description of the present embodiments, detailed descriptions of known functions and components incorporated herein will be omitted in the case that the subject matter of the embodiments disclosed herein may be rendered unclear thereby.

It will also be understood that, although terms such as "first," "second," "A," "B," "(a)" and "(b)" may be used herein to describe various elements, such terms are only used to distinguish one element from another element. The substance, sequence, order or number of these elements is not limited by these terms. It will be understood that when an element is referred to as being "connected to" or "coupled to" another element, not only can it be "directly connected" or "coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 is a configuration view illustrating a display device 100 according to present embodiments.

Referring to FIG. 1, the display device 100 according to the present embodiments includes a display panel 110, a data driver 120, a gate driver 130, and a timing controller 140.

On the display panel 110, a plurality of data lines DL are disposed in a first direction, a plurality of gate lines GL are disposed in a second direction intersecting the first direction, and a plurality of subpixels SP are arranged in a matrix. The data driver 120 drives the plurality of data lines DL by supplying data voltages thereto. The gate driver 130 sequentially drives the plurality of gate lines GL by sequentially supplying a scanning signal to the plurality of gate lines. The timing controller 140 controls the data driver 120 and the gate driver 130 by supplying control signals to the data driver 120 and the gate driver 130.

The timing controller 140 starts scanning operation at a corresponding time for each frame, outputs converted image data Data' by converting image data Data input from a host system 160 into a data signal format used by the data driver 120, and regulates data processing at a suitable point in time in response to the scanning.

The gate driver 130 sequentially drives the plurality of gate lines by sequentially supplying the scanning signal having an on or off voltage to the plurality of gate lines under the control of the timing controller 140.

The gate driver 130 may be positioned on one side of the display panel 110, as illustrated in FIG. 1. Depending on the driving method, the gate driver 130 may be divided into two sections, positioned on both sides of the display panel 110.

In addition, the gate driver 130 includes a plurality of gate driver ICs GDIC #1, GDIC #2, . . . , and GDIC #N (where N is a natural number equal to or greater than 1). Each of the plurality of gate driver ICs GDIC #1 to GDIC #N may be connected to the bonding pads of the display panel 110 by tape-automated bonding (TAB) or chip-on-glass (COG) bonding, may be implemented as a gate-in-panel (GIP)-type IC directly disposed on the display panel 110, or in some cases, may be integrated with the display panel 110, forming a portion of the display panel 110.

Each of the above-mentioned gate driver ICs GDIC #1 to GDIC #N includes a shift resistor, a level shifter, and the like.

When a specific gate line is opened, the data driver 120 drives the data lines by converting image data Data' received from the timing controller 140 into analog data voltages Vdata and supplying the analog data voltages Vdata to the data lines.

The data driver 120 includes a plurality of source driver ICs (also referred to as data driver ICs) SDIC #1, SDIC #2, . . . , and SDIC #M (where M is a natural number equal to or greater than 1). Each of the plurality of source driver ICs SDIC #1 to SDIC #M may be connected to the bonding pads of the display panel 110 by tape-automated bonding (TAB) or chip-on-glass (COG) bonding, may be directly disposed on the display panel 110, or in some cases, may be integrated with the display panel 110, forming a portion of the display panel 110.

Each of the above-mentioned source driver ICs SDIC #1 to SDIC #M includes a shift resistor, a latch, a digital-to-analog converter (DAC), an output buffer, and the like. In some cases, each source driver IC may include an analog-to-digital converter (ADC) for subpixel compensation. The ADC senses an analog voltage value, converts the sensed analog voltage value to a digital value, and generates and outputs sensed data.

The plurality of source driver ICs SDIC #1 to SDIC #M are formed using a chip-on-film (COF) method. In each of the plurality of source driver ICs SDIC #1 to SDIC #M, one end is bonded to at least one source printed circuit board (SPCB), and the other end is bonded to the display panel 110.

The above-mentioned host system transmits a variety of timing signals including a vertical synchronization signal Vsync, a horizontal synchronization signal Hsync, an input data enable (DE) signal, and a clock (CLK) signal together with the image data Data of an input image to the timing controller 140.

The timing controller 140 converts image data Data input from the host system 160 into a data signal format used in the data driver 120 and outputs converted image data Data'. In addition, the timing controller 140 receives timing signals, including a vertical synchronization signal Vsync, a horizontal synchronization signal Hsync, an input DE signal, and a clock signal, generates a variety of control signals based on the input timing signals, and outputs the variety of control signals to the data driver 120 and the gate driver 130 in order to control the data driver 120 and the gate driver 130.

For example, the timing controller 140 outputs a variety of gate control signals (GCSs) including a gate start pulse (GSP), a gate shift clock (GSC) signal, and a gate output enable (GOE) signal in order to control the gate driver 130. The GSP controls the operation start timing of the gate driver ICs GDIC #1 to GDIC #N of the gate driver 130. The GSC signal is a clock signal commonly input to the gate driver ICs GDIC #1 to GDIC #N to control the shift timing of a scanning signal (gate pulse). The GOE signal designates the timing information of the gate driver ICs GDIC #1 to GDIC #N.

The timing controller 140 outputs a variety of data control signals (DCSs) including a source start pulse (SSP), a source sampling clock (SSC) signal, and a source output enable (SOE) signal in order to control the data driver 120. The SSP controls the data sampling start timing of the source driver ICs SDIC #1 to SDIC #M of the data driver 120. The SSC signal is a clock signal to control the data sampling timing of each of the source driver ICs SDIC #1 to SDIC #M. The SOE signal controls the output timing of the data driver 120. In some cases, the DCSs may further include a polarity (POL) control signal in order to control the polarity of the data voltages of the data driver 120. The SSP and SSC signals may be omitted when image data Data' input into the data driver 120 is transmitted, based on the mini-low voltage differential signaling (m-LVDS) interface specification.

Referring to FIG. 1, the display device 100 further includes a power controller 150 that supplies a variety of voltages or currents to the display panel 110, the data driver 120, the gate driver 130, and the like, or controls the variety of voltages or currents to be supplied.

The power controller 150 is also referred to as a power management IC (PMIC).

The display device 100 simplified in FIG. 1 may be one selected from among, but not be limited to, a liquid crystal display (LCD) device, a plasma display device, and an organic light-emitting diode (OLED) display device.

Circuit elements, such as a transistor, a capacitor, and the like, are disposed on each of the subpixels SP formed on the display panel 110. For example, when the display panel 110 is an OLED display panel, a circuit including an OLED, two or more transistors, and one or more capacitor is disposed on each of the subpixels.

Figure 2:
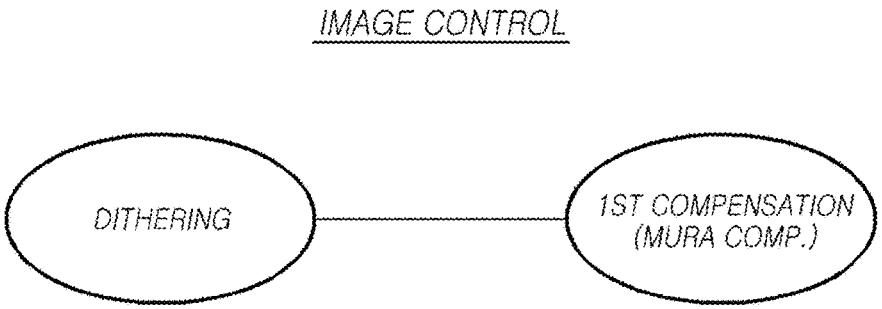
FIG. 2 is a diagram illustrating two image control operations of the display device according to the present embodiments.
Figure 3:
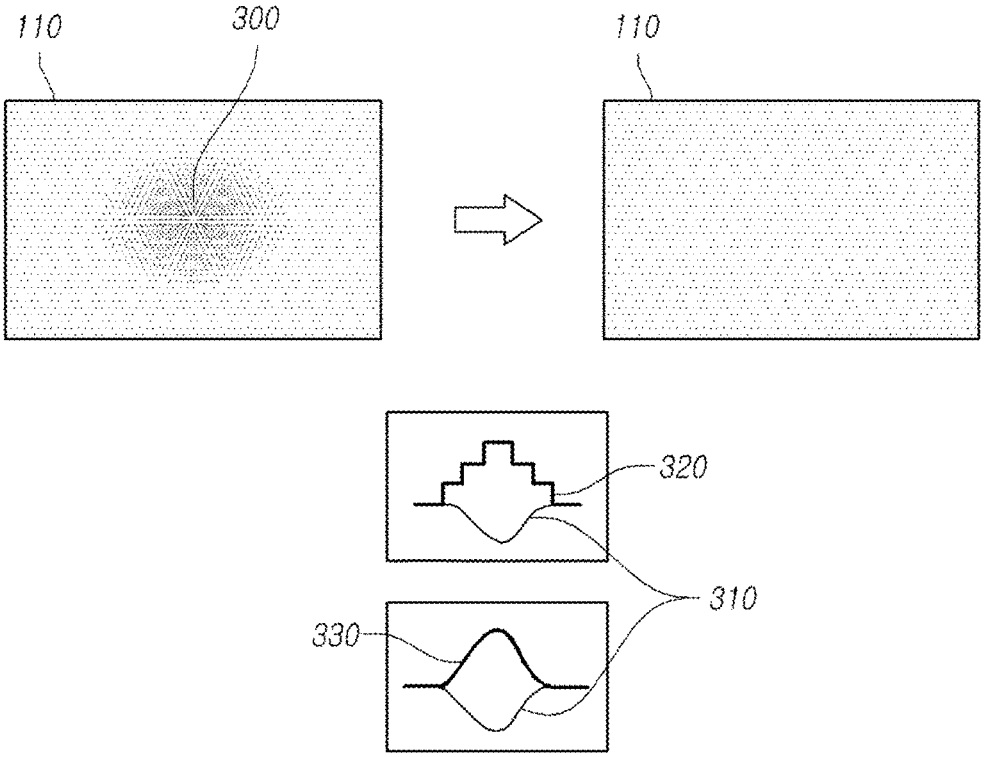
FIG. 3 is a conceptual diagram illustrating the first compensation control operation of the display device according to the present embodiments.
Figure 4:
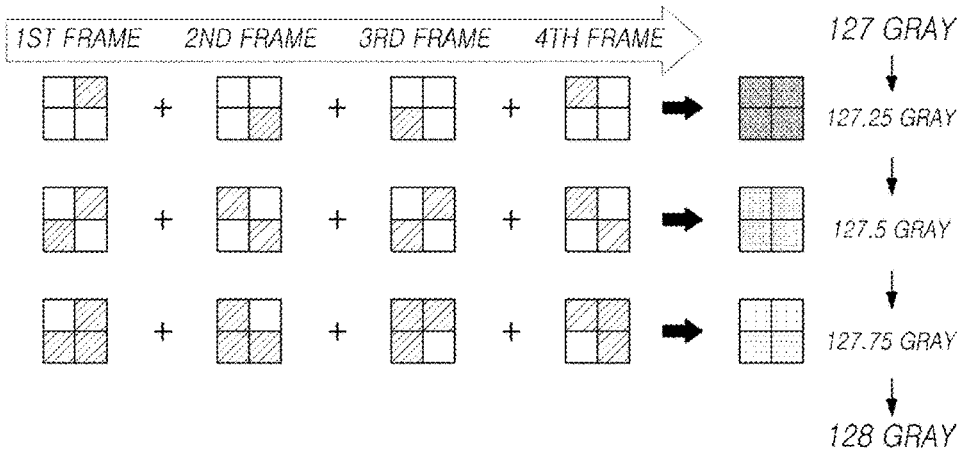
FIG. 4 is a conceptual diagram illustrating the dithering control operation of the display device according to the present embodiments.

FIG. 2 is a conceptual diagram illustrating two image control operations of the display device 100 according to the present embodiments, FIG. 3 is a conceptual diagram illustrating the first compensation control operation of the display device 100 according to the present embodiments, and FIG. 4 is a conceptual diagram illustrating the dithering control operation of the display device 100 according to the present embodiments.

Referring to FIG. 2, the display device 100 according to the present embodiments can provide two image control operations, including the dithering control operation and the first compensation control operation.

Referring to FIG. 3, the first compensation control is intended for Mura compensation reducing the visibility of a stain 300 formed on the display panel 110. The stain 300 may be generally formed in low-grayscale level areas.

Referring to FIG. 3, the timing controller 140 executes the first compensation control operation by calculating first compensation values 320 and 330 based on stain data indicating the stain 300 formed on the display panel 110, generating first compensated image data by adding the calculated first compensation values 320 and 330 to image data of a subpixel of an area in which the stain 300 is formed, and supplying the first compensated image data to at least one corresponding source driver IC.

Referring to FIG. 3, among the two first compensation values 320 and 330, the profile of the first compensation value 330 corresponds to an inverted profile of stain data 310. The first compensation value 330 having this profile is calculated more precisely considering the profile of the stain data 310. For example, the first compensation value 330 may be a camera compensation value based on the stain data 310, obtained by taking an imaging of the stain 300 using a camera. The camera compensation value may be saved in memory before the shipping of the display panel 110, obtained during the process of fabricating the display panel 110.

Referring to FIG. 4, the dithering control is intended to express a greater number of grayscale levels than the number of grayscale levels of each of the plurality of source driver ICs SDIC #1 to SDIC #M.

For example, when each of the plurality of source driver ICs SDIC #1 to SDIC #M can generate eight voltage levels by receiving 3-bit image data, the dithering control may be a control method to express 32 grayscale levels instead of 8 grayscale levels.

For example, when four subpixels are assumed to be a single unit, five grayscale levels can be expressed in a single unit by varying the number of the subpixels to which a high-grayscale level data voltage is applied (hatched subpixels), i.e., the number of the subpixels to which the high-grayscale level data voltage is applied may be 0, 1, 2, 3, or 4.

Referring to FIG. 4, in terms of frames, when the four subpixels are assumed to be one unit, during the period from the first frame to the fourth frame, high-grayscale level data voltages (hatched portions) may be applied in different amounts of times, for example, one, two, or three times. Consequently, a viewer may experience a variety of grayscale levels in one unit during the period of four frames.

Referring to FIG. 4, the dithering control can express more precise grayscale levels, for example, between 127 gray level and 128 gray level. That is, grayscale levels smaller than 1 gray level can be expressed.

Figure 5:
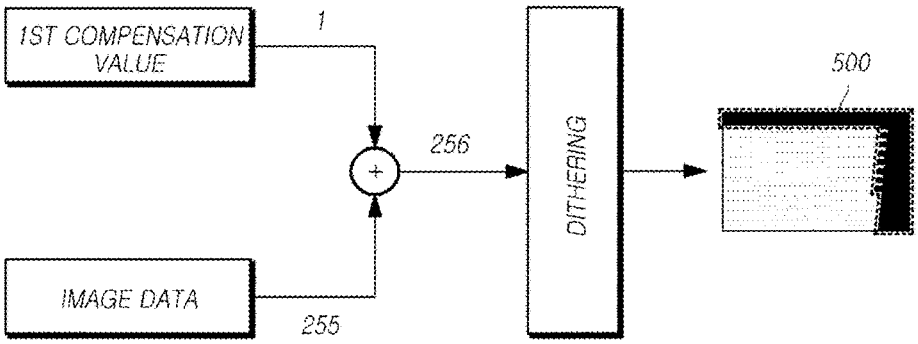
FIG. 5 illustrates exemplary first compensation control and exemplary dithering control in the display device according to the present embodiments.
Figure 6:
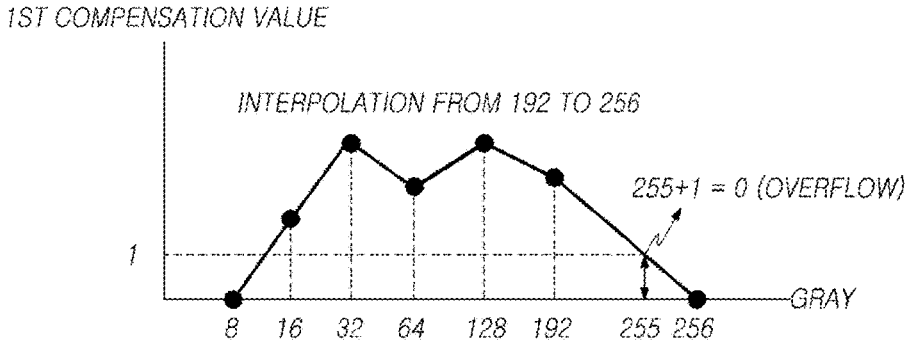
FIG. 6 illustrates an exemplary interpolation graph of the display device according to the present embodiments.

FIG. 5 illustrates exemplary first compensation control and exemplary dithering control in the display device according to the present embodiments. FIG. 6 illustrates an exemplary interpolation graph of the display device according to the present embodiments. In the following, it will be assumed that a signal is an 8-bit image signal.

Referring to FIG. 5, the display device 100 according to the present embodiments represents an image by adding image data and a first compensation value and executing the dithering control operation using a dithering pattern.

In one embodiment, the image data added to the first compensation value may be white, red, green, and blue (WRGB) data generated by the timing controller 140 by converting red, green, and blue (RGB) data input from the host system 160.

Referring to FIG. 6, the first compensation value may be obtained by interpolation.

Referring to FIG. 5 and FIG. 6, in compensation by adding the interpolated first compensation value to the image data, when the first compensation value has a specific value (e.g., 1) at the maximum grayscale level of the image data, i.e., at 255 gray level, adding the first compensation value (1) to the image data (255) creates an overflow.

When the first compensated image data is generated by adding the first compensation value, a specific value other than 0, to the image data corresponding to the maximum grayscale level, the first compensated image data is greater than the maximum grayscale level.

Referring to the example illustrated in FIG. 6, first compensation is performed for specific gray levels (e.g. $2^3$, $2^4$, $2^5$, $2^6$, $2^7$, and $2^8$). For grays (e.g. 192 gray level to 256 gray level) to which the first compensation is not applied, first compensation values are calculated through interpolation and subsequently are applied to image representation.

However, referring to the example illustrated in FIG. 6, interpolation is possible between adjacent gray levels by the unit of the nth power of 2 ($2^n$, for example, $2^3$, $2^4$, $2^6$, $2^6$, $2^7$, or $2^8$) or by the unit of a combination of the nth powers of 2 (e.g. $192=2^7+2^6$). After 192 gray level, the interpolated value becomes 256 gray level ($=2^8$), exceeding the maximum grayscale level 255.

When the overflow greater than the maximum grayscale level occurs, the corresponding subpixel may appear to have the same appearance as a dark defect. This phenomenon is referred to as "pixel failure."

Referring to FIG. 5, when several subpixels appearing to be a dark defect are present in a peripheral area 500 of the display panel 110, the peripheral area 500 may appear to be a dark defect, thereby significantly degrading image quality.

Figure 7:
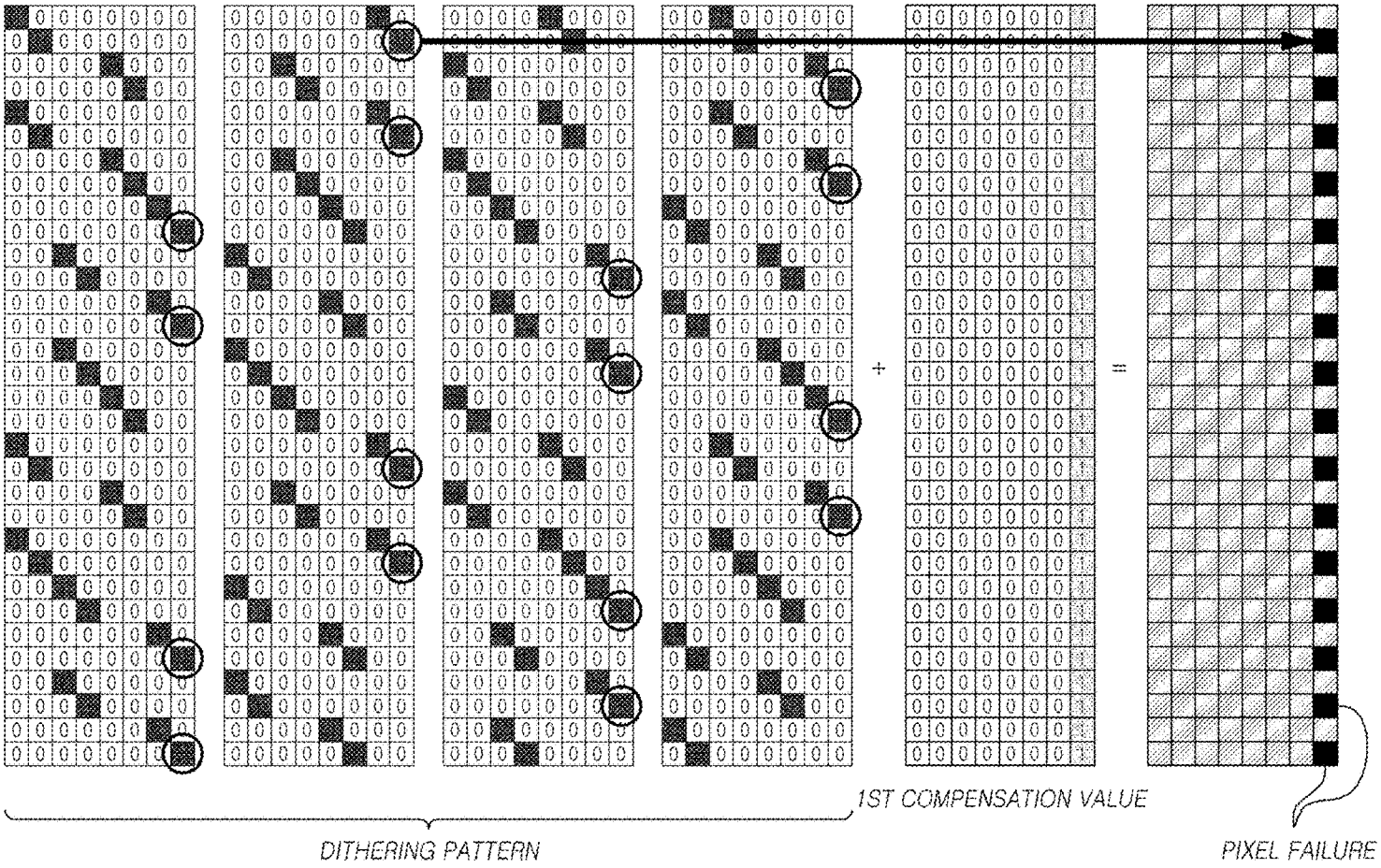
FIG. 7 illustrates pixel failure in the display device according to the present embodiments.

As illustrated in FIG. 7, first compensated image data is obtained by adding the interpolated first compensation value to the image data based on the dithering pattern. The image is represented based on the first compensated image data. When pixel failure occurs in a plurality of subpixels, a plurality of dark defects are formed, thereby significantly degrading image quality. In a severe case, the plurality of dark defects may be misconceived as a physical dark point caused by, for example, a disconnection in a circuit element, such as a transistor, or a signal line. Thus, the plurality of dark defects are highly likely to be regarded as defects in the display panel 110.

Therefore, the present embodiments allow a variable dithering control (VDC) method in order to prevent pixel failure that would otherwise occur during the first compensation control operation and the dithering control operation.

Hereinafter, the VDC method will be described in detail with reference to FIG. 8 to FIG. 16.

Figure 8:
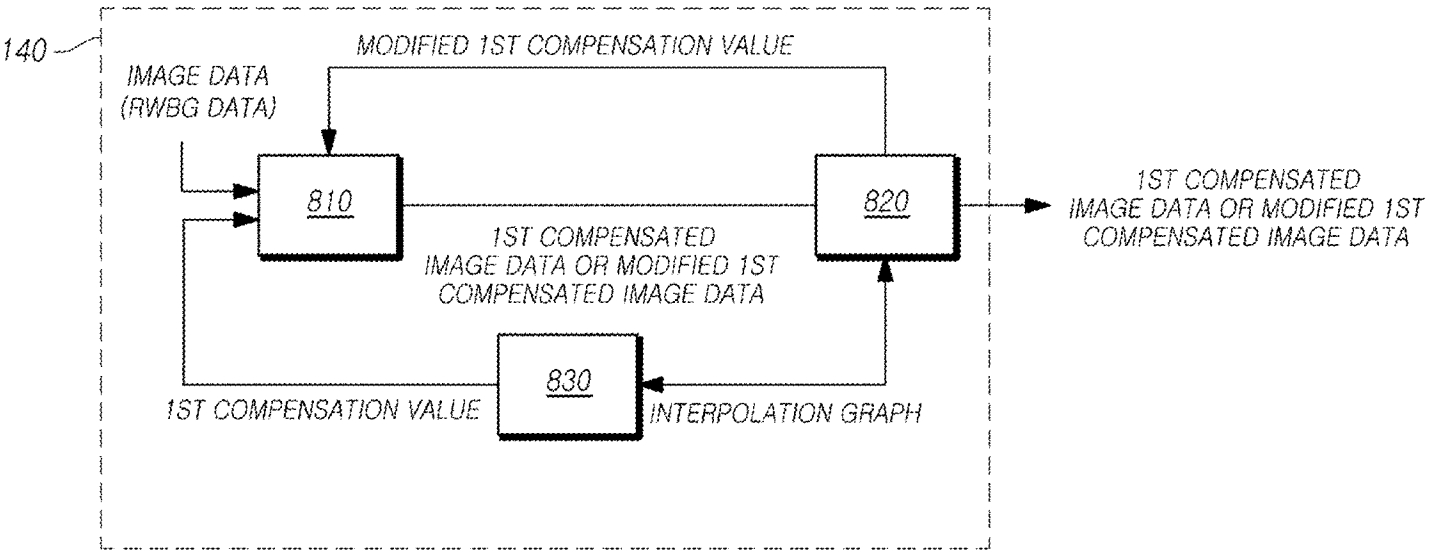
FIG. 8 is a block diagram of the timing controller performing a variable dithering control (VDC) operation in the display device according to the present embodiments.
Figure 9:
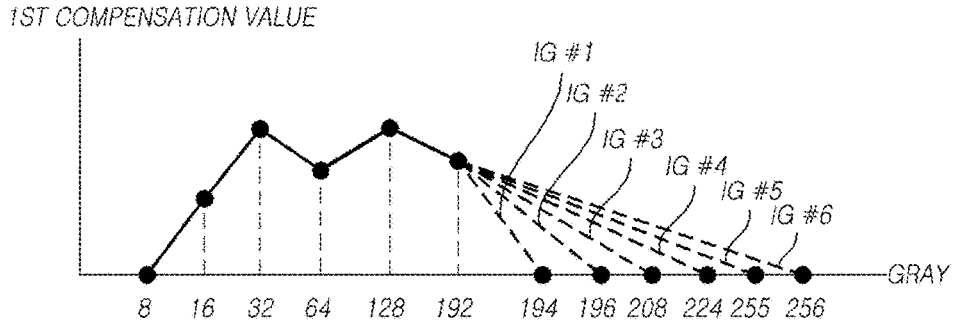
FIG. 9 illustrates a plurality of exemplary interpolation graphs for the VDC operation in the display device according to the present embodiments.

FIG. 8 is a block diagram of the timing controller 140 performing a VDC operation in the display device 100 according to the present embodiments. FIG. 9 illustrates a plurality of exemplary interpolation graphs for the VDC operation in the display device 100 according to the present embodiments.

Referring to FIG. 8, the timing controller 140 of the display device 100 according to the present embodiments includes a first compensation controller 810 and a variable dithering controller 820.

Referring to FIG. 8, the first compensation controller 810 generates first compensated image data by adding first compensation values to image data.

Referring to FIG. 8, the variable dithering controller 820 outputs the first compensated image data as it is when the first compensated image data, generated through the first compensation control operation by the first compensation controller 810, is equal to or smaller than the maximum grayscale level (e.g. 255 gray level). When the first compensated image data is greater than the maximum grayscale level, the variable dithering controller 820 generates modified first compensated image data by modifying the first compensated image data such that the modified first compensated image is equal to or smaller than the maximum grayscale level.

The VDC operation as above can prevent an image from being represented as the first compensated image data exceeding the maximum grayscale level, thereby preventing pixel failure.

According to the above-described features, the display device 100 according to the present embodiments includes the display panel 110 on which the data lines and the gate lines are disposed and the subpixels are arranged in a matrix, the timing controller 140 outputs image data by compensating the image data, and the data driver 120 electrically connected to the timing controller 140 and the data lines. The data driver 120 converts the image data output from the timing controller 140 to data voltages and the outputs the data voltages to the data lines. Here, dark defects due to overflow in the compensation can be eschewed.

In an image control system for performing dithering by adding image data and first compensation values, the above-described VDC operation can prevent a subpixel from having the appearance of a dark defect due to pixel failure formed in the subpixel even in the case in which image data (WRGB data) corresponds to the maximum grayscale level (e.g. 255 gray level in an 8-bit image signal).

The first compensation value as mentioned above is a stain compensation value, which may be an image data compensation value in a first grayscale level area, previously determined as a grayscale level area in which stains will be mainly formed.

Since the first compensation value is defined as the image data compensation value in the first grayscale level area previously determined as the grayscale level area in which stains will be mainly formed, it is possible to compensate for stains.

In addition, the image data as mentioned above may be RGB data input to the timing controller 140 from the host system 160 or WRGB data converted from the RGB data by the timing controller 140.

With the above-described features, the VDC operation according to the present embodiments can be applied to any case in which the display panel 110 has an RGB subpixel structure or in which the display panel 110 has an WRGB subpixel structure.

Referring to FIG. 8 and FIG. 9, the variable dithering controller 820 does not determine the first compensation value corresponding to the image data by referring to only a single fixed interpolation graph (IG), as illustrated in FIG. 6, when modifying the first compensated image data exceeding the maximum grayscale level. Instead, the variable dithering controller 820 can modify the first compensated image data by determining the first compensation value corresponding to the image data using a single interpolation graph able to prevent an overflow, selected from a plurality of interpolation graphs IG #1, IG #2, . . . , and IG #6.

Thus, the display device 100 according to the present embodiments further includes a memory 830, as illustrated in FIG. 8. The memory 830 saves graph data regarding the plurality of interpolation graphs IG #1 to IG #6 to which the variable dithering controller 820 refers when modifying the first compensated image data.

The memory 830 may be disposed within the timing controller 140, as illustrated in FIG. 8, or may be disposed outside of the timing controller 140.

The graph data regarding the plurality of interpolation graphs IG #1 to IG #6 are referred to as a plurality of pieces of VDC data.

Referring to FIG. 9, among the plurality of interpolation graphs IG #1 to IG #6, the magnitude of the gradient of the interpolation graph IG #6 is the lowest. The magnitude of the gradient of the interpolation graphs increases from the IG #6 to IG #1. That is, the gradient of IG #1 is the steepest, and the gradient of the interpolation graph IG #6 is the flattest.

Referring to FIG. 9, the plurality of interpolation graphs IG #1 to IG #6 indicate first compensation values about grayscale levels.

Referring to FIG. 9, the plurality of interpolation graphs IG #1 to IG #6 may have different gradients in a specific range of grayscale levels (a high grayscale level range, for example, from 192 gray level to 256 gray level).

Since the gradients of the plurality of interpolation graphs IG #1 to IG #6 have different gradients in the specific range of grayscale levels as described above, interpolation is possible in the specific range of grayscale levels, i.e., the maximum grayscale level and a range of grayscale levels close to the maximum grayscale level.

Referring to FIG. 8 and FIG. 9, when the first compensated image data is greater than the maximum grayscale level, the variable dithering controller 820 selects an interpolation graph among the plurality of interpolation graphs IG #1 to IG #6. On the selected interpolation graph, the first compensated image data is equal to or smaller than the maximum grayscale level. The variable dithering controller 820 determines a modified first compensation value by referring to the selected interpolation graph. The modified first compensation value is added to the image data to obtain a value equal to or smaller than the maximum grayscale level. The variable dithering controller 820 outputs modified first compensated image data equal to or smaller than the maximum grayscale level, obtained by adding the modified first compensation value to the image data.

As described above, the variable dithering controller 820 can output the modified first compensated image data free from pixel failure by effectively modifying the first compensated image data determined to be vulnerable to pixel failure.

Referring to FIG. 9, with increases in the amount by which the first compensated image data is greater than the maximum grayscale level, the variable dithering controller 820 selects an interpolation graph having a steeper gradient in the specific range of grayscale levels (e.g., from 192 gray level to 256 gray level) among the plurality of interpolation graphs IG #1 to IG #6.

As described above, when the amount by which the first compensated image data is greater than the maximum grayscale level increases, i.e., when the first compensated image data is greater than the maximum grayscale level by a greater amount, it is possible to determine the modified first compensation value from the interpolation graph having a steeper gradient, thereby adaptively preventing an overflow.

As described above, the display device 100 according to the present embodiments includes the display panel 110, the timing controller 140, and the data driver 120. Specifically, on the display panel 110, the data lines and the gate lines are disposed and the subpixels are arranged in a matrix. The timing controller 140 modifies image data based on an interpolation graph among a plurality of pieces of VDC data (interpolation graphs), which variously define compensation values about grayscale levels, and outputs the modified image data. The data driver 120 is electrically connected to the timing controller 140 and the data lines. The data driver 120 converts the modified image data, received from the timing controller 140, into data voltages and subsequently outputs the data voltages to the data lines.

It is possible to represent an image by modifying image data through the above-described VDC operation, thereby improving image quality.

Figure 10:
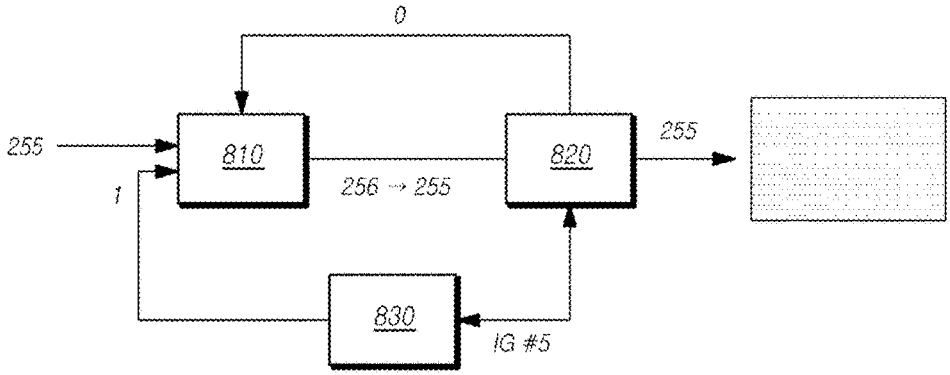
FIG. 10 is a block diagram illustrating an exemplary VDC operation in the display device according to the present embodiments.

FIG. 10 is a block diagram illustrating an exemplary VDC operation in the display device 100 according to the present embodiments.

Hereinafter, the VDC method, which has been described with reference to FIG. 9, will be described by way of an example with reference to FIG. 10.

In FIG. 10, it will be assumed that an 8-bit image signal containing image data (WRGB data) having a maximum grayscale level, i.e., 255 gray level, is input to the first compensation controller 810.

Referring to FIG. 10, the first compensation controller 810 adds 255 gray corresponding to the image data and 1 gray level corresponding to a first compensation value of the image data, and outputs first compensated image data corresponding to "256" gray level.

Referring to FIG. 10, the variable dithering controller 820 determines whether or not the grayscale level of the first compensated image data is greater than the maximum grayscale level. Here, the maximum grayscale level is 255 ($=2^8-1$).

Since 256 gray level, the grayscale level of the first compensated image data, is greater than 255 gray level, the maximum grayscale level, the variable dithering controller 820 determines a modified first compensation value by selecting graph data corresponding to an interpolation graph among the plurality of interpolation graphs IG #1 to IG #6, saved in the memory 830. The modified first compensation value is added to 255 gray level, corresponding to the grayscale level of the image data, to produce a value equal to or smaller than 255 gray level, the maximum grayscale level.

Here, it is assumed that IG #5 is selected among the six interpolation graphs IG #1 to IG #6 illustrated in FIG. 9.

Referring to FIG. 10, the variable dithering controller 820 determines the first compensation value corresponding to 255 gray level, the grayscale level of the image data, by referring to selected IG #5.

In IG #5 of FIG. 9, a first compensation value corresponding to 255 gray level is zero (0).

The variable dithering controller 820 sends the determined first compensation value 0 to the first compensation controller 810.

The first compensation controller 810 generates and outputs modified first compensated image data having "255 gray level" by adding the first compensation value "0", received from the first compensation controller 810, to 255 gray level, the grayscale level of the image data.

Then, the variable dithering controller 820 outputs the modified first compensated image data by checking that 255 gray level, the grayscale level of the modified first compensated image data, is equal to or smaller than the maximum grayscale level (255 gray level).

After the first compensation value is determined to be 0, the variable dithering controller 820 may not send the determined first compensation value to the first compensation controller 810, but may generate the modified first compensated image data by itself.

When the image is represented using the modified first compensated image data output by the variable dithering controller 820, the area appearing to be a dark defect due to pixel failure, as illustrated in FIG. 5, is removed.

Hence, the VDC operation disclosed herein can prevent pixel failure.

Figure 11:
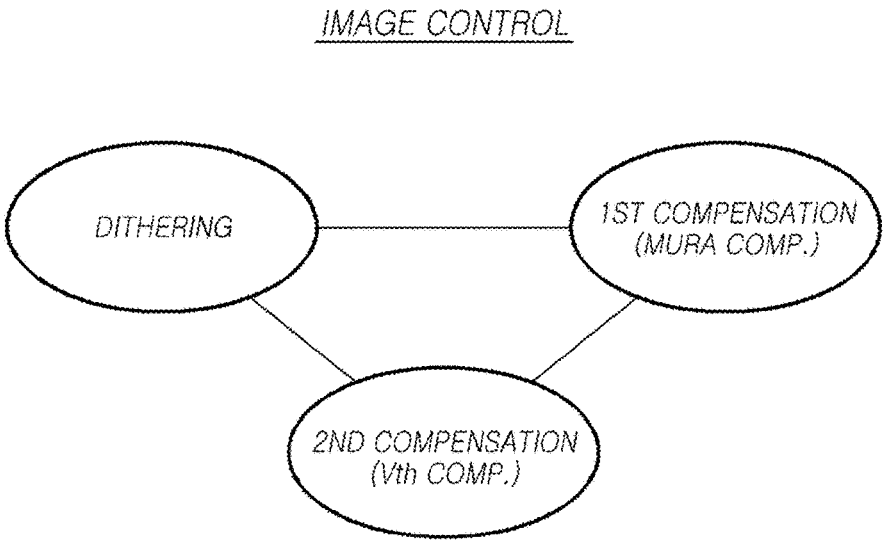
FIG. 11 is a conceptual diagram illustrating three image control operations according to the present embodiments.

FIG. 11 is a conceptual diagram illustrating three image control operations according to the present embodiments.

Referring to FIG. 11, the display device 100 according to the present embodiments further enables a second compensation control operation as image control technology, in addition to the dithering control operation and the first compensation control (stain compensation control) operation.

The second compensation control operation is an image control technology able to compensate for the difference in the luminance between subpixels. Specifically, the second compensation control operation includes sensing the threshold voltages Vth of transistors in the subpixels and compensating for the difference in the threshold voltage between the transistors in the subpixels.

The second compensation control operation includes an operation of sensing the voltage of a sensing node in each of the subpixels in order to sense the threshold voltage of the transistor of each of the subpixels and an operation of compensating for the difference in the threshold voltage between the transistors in the subpixels.

Figure 12:
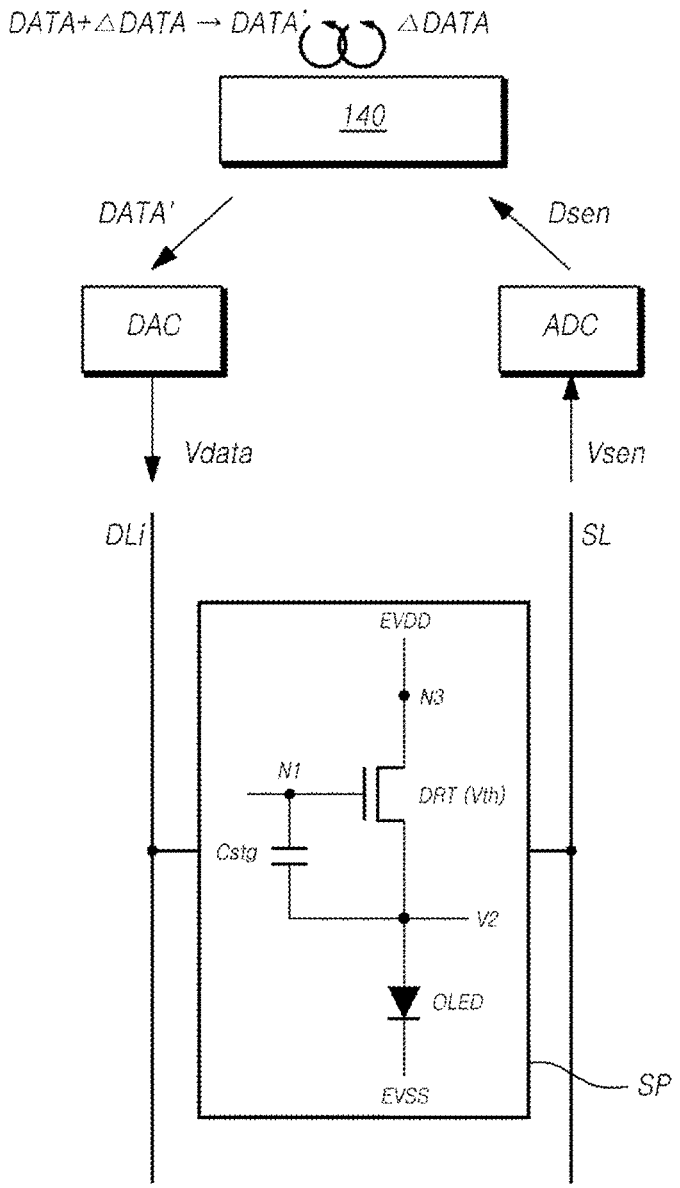
FIG. 12 and FIG. 13 are diagrams illustrating the second compensation control operation of the display device according to the present embodiments.
Figure 13:
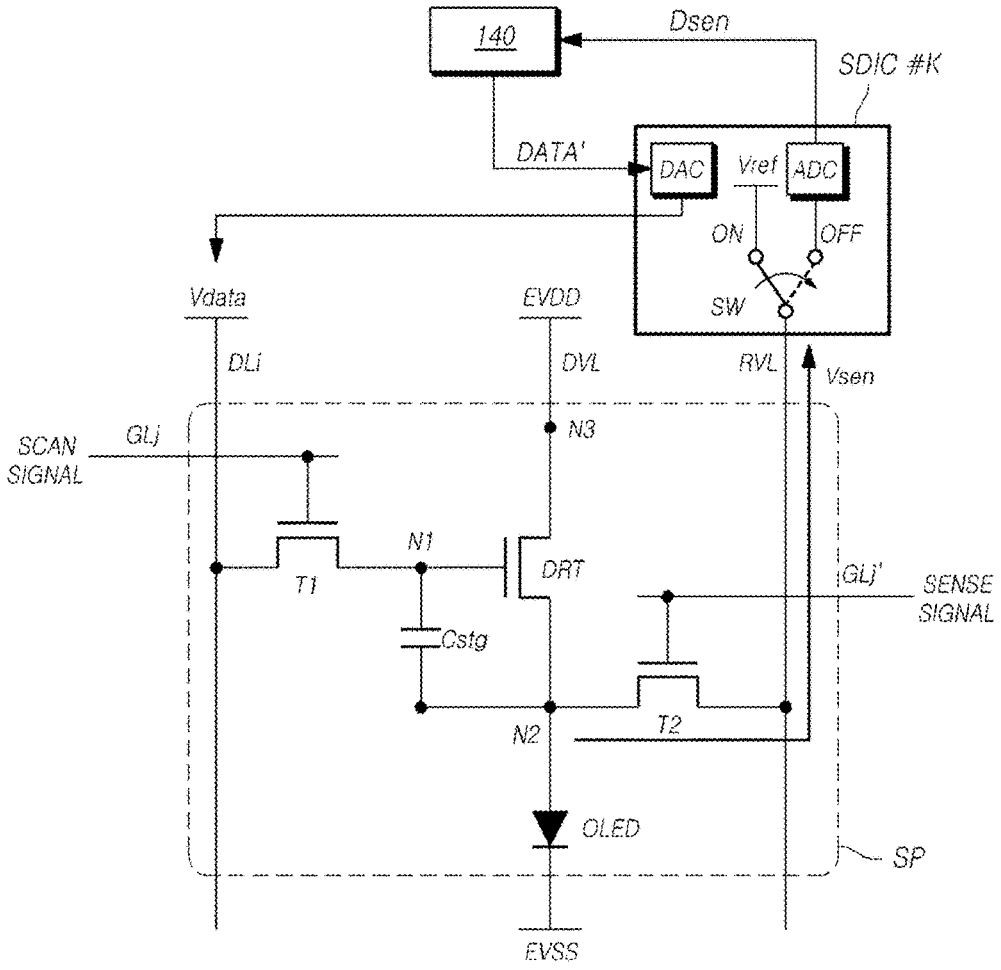

FIG. 12 and FIG. 13 are diagrams illustrating the second compensation control operation of the display device 100 according to the present embodiments. Here, it is assumed that the display device 100 is an OLED display device.

Referring to FIG. 12 and FIG. 13, each of subpixels SP includes an OLED, a driving transistor DRT driving the OLED, a storage capacitor Cstg maintaining a constant level of voltage for a period of a single frame, and the like.

Referring to FIG. 12 and FIG. 13, the display device 100 according to the present embodiments has a configuration for performing the second compensation control operation. This configuration includes an ADC sensing the voltage of a sensing node in each of the subpixels in order to sense the threshold voltages of the transistors in the subpixels, a sensing line SL connecting the sensing node in each of the subpixels to the ADC, the timing controller 140 executing data compensation using the sensing result of the ADC, and the like.

Referring to FIG. 12 and FIG. 13, for the period of the sensing operation, the ADC senses (measures) the voltage of a specific sensing node in each of one or more subpixels SP, converts the sensed voltage Vsen to a digital value, and transmits sensed data Dsen including the converted digital value(s) to the timing controller 140 in order to sense the threshold voltage Vth of the driving transistor DRT driving the OLED in each of the subpixels SP.

Referring to FIG. 12 and FIG. 13, for the period of the compensation operation, the timing controller 140 determines a data compensation amount ΔData for each of the subpixels, based on the sensed data Dsen.

The timing controller 140 generates second compensated image data Data' by adding the determined data compensation amount ΔData to corresponding image data Data, and transmits the second compensated image data Data' to a corresponding source driver IC SDIC #K, where K=1, 2, . . . , or M.

The corresponding source driver IC SDIC #K converts the second compensated image data Data' to a data voltage using a DAC disposed therein and subsequently outputs the data voltage to a corresponding data line DLi. In this manner, second compensation is performed.

Reference will be made to FIG. 13 more specifically illustrating the subpixel structure. In each of the subpixels SP, a driving circuit for driving the OLED may have, for example, a three-transistor and one-capacitor (3T1C) structure including three transistors DRT, T1, and T2 and a single storage capacitor Cstg.

Referring to FIG. 13, the driving transistor DRT includes a first node N1 to which a data voltage Vdata is applied, a second node N2 electrically connected to a first electrode (e.g., an anode or a cathode) of the OLED, and a third node N3 electrically connected to a driving voltage line DVL through which a driving voltage EVDD is applied thereto.

Referring to FIG. 13, the first transistor T1 is electrically connected between the data line DLi through which the data voltage is supplied and the first node N1 of the driving transistor DRT.

The gate node of the first transistor T1 receives a scanning signal through a first gate line GLj. A drain node or a source node of the first transistor T1 receives the data voltage Vdata through the data line DLi. The source node or the drain node of the first transistor T1 is electrically connected to the first node N1 of the driving transistor DRT.

When the first transistor T1 is turned on in response to the scanning signal, the first transistor T1 applies the data voltage Vdata supplied to the drain node or the source node thereof to the first node N1 of the driving transistor DRT electrically connected to the source node or the drain node thereof.

Referring to FIG. 13, the second transistor T2 is electrically connected between a reference voltage line RVL through which a reference voltage Vref is supplied and the second node N2 of the driving transistor DRT.

The gate node of the second transistor T2 receives a sensing signal, a type of scanning signal, through a second gate line GLj'. The drain node or the source node of the second transistor T2 receives the reference voltage Vref through the reference voltage line RVL. The source node or the drain node of the second transistor T2 is electrically connected to the second node N2 of the driving transistor DRT.

Referring to FIG. 13, the storage capacitor Cstg is electrically connected between the first node N1 and the second node N2 of the driving transistor DRT.

The 3T1C subpixel structure illustrated in FIG. 13 enables sensing and compensation for the subpixel.

Referring to FIG. 13, the ADC senses a voltage of the second node N2 of the driving transistor DRT, corresponding to the sensing node, through the reference voltage line RVL, converts the sensed voltage Vsen to a digital value, and transmits sensed data including the converted digital value to the timing controller 140.

Consequently, the timing controller 140 determines the data compensation amount ΔData by performing a compensation process using the received sensed data Dsen.

The timing controller 140 modifies the image data Data, WRGB data produced by converting RGB data input from an external source, based on the data compensation amount ΔData, and transmits modified second compensated image data Data' to the corresponding source driver IC SDIC #K, where K=1, 2, . . . , or M.

Consequently, the corresponding source driver IC SDIC #K converts the second compensated image data Data' to a data voltage Vdata and subsequently supplies the data voltage Vdata to the corresponding data line DLi.

As illustrated in FIG. 13, the ADC may be included in the corresponding source driver IC SDIC #K, where K=1, 2, . . . , or M.

As described above, the 3T1C subpixel structure according to the present disclosure can reduce the sensing time by accelerating the voltage saturation rate of a sensing node SN, the second node N2 of the driving transistor DRT, by adjusting the data voltage and/or the driving voltage.

Referring to FIG. 13, a switch SW is further provided. The switch SW connects the reference voltage line RVL to a reference voltage supply node or the ADC. Here, the reference voltage from the power controller 150 is supplied to the source driver IC SDIC #K through the reference voltage supply node. The switch SW is turned on by the reference voltage supply node.

For the period of the sensing operation, the switch SW is turned on at an initial point in time of the sensing operation to apply the reference voltage Vref to the second node N2 of the driving transistor DRT. After the voltage is saturated due to the floating of the second node N2 of the driving transistor DRT, the switch SW is turned off, connecting the reference voltage line RVL to the ADC at a point in time to sense the voltage of the second node N2 of the driving transistor DRT.

Alternatively, the floating of the second node N2 of the driving transistor DRT may be enabled in response to the second transistor T2 being turned off.

In addition, the floating of the second node N2 of the driving transistor DRT may not be realized by two operations, i.e., on and off operations. The floating of the second node N2 of the driving transistor DRT may be realized by the following three switching operations: a switching operation of connecting the reference voltage supply node to the reference voltage line RVL; a switching operation of connecting the ADC and the reference voltage line RVL; and a switching operation of disconnecting both the reference voltage supply node and the ADC from the reference voltage line RVL.

The timing of the switching operation of the switch SW may be controlled by a control signal output by the timing controller 140.

Through the above-described switch SW, it is possible to apply a voltage to the second node N2 of the driving transistor DRT or sense a voltage thereon at an intended point in time according to the sensing operation.

In FIG. 13, the sensing node SN in each of the subpixels SP is the second node N2 of the driving transistor DRT. In addition, the reference voltage line RVL illustrated in FIG. 13 corresponds to the sensing line SL in FIG. 12.

Figure 14:
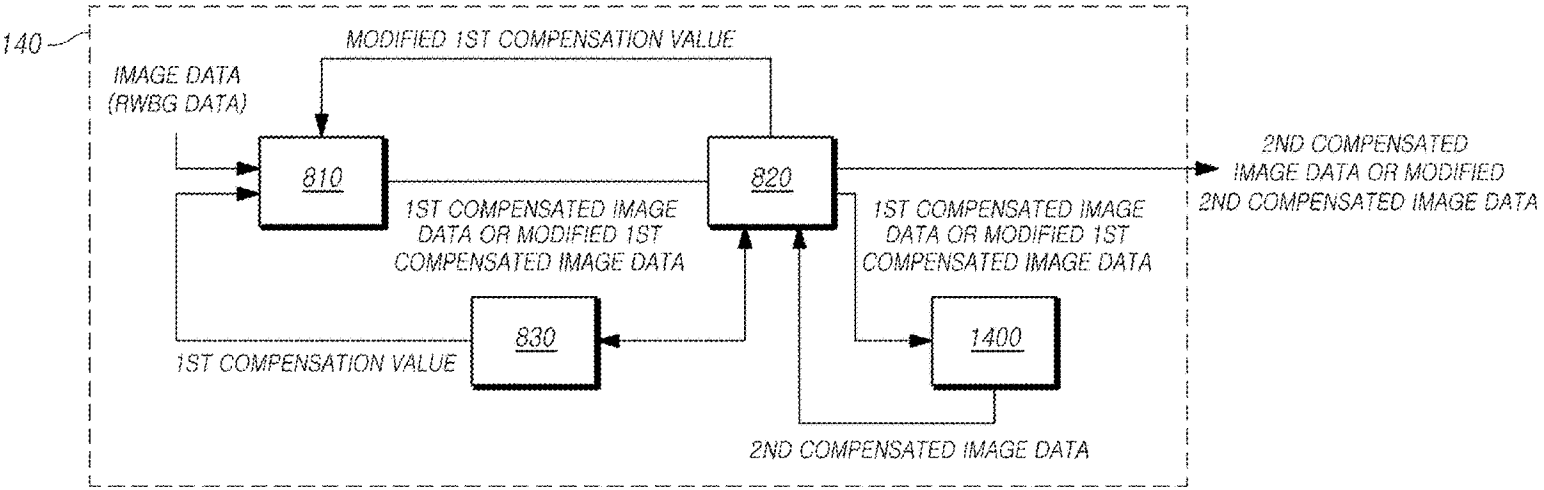
FIG. 14 is a block diagram illustrating another exemplary VDC operation performed by the timing controller in the display device according to the present embodiments.

FIG. 14 is a block diagram illustrating another exemplary VDC operation performed by the timing controller 140 in the display device 100 according to the present embodiments.

Referring to FIG. 14, the timing controller 140 includes not only the first compensation controller 810 and the variable dithering controller 820, as in FIG. 8, but also a second compensation controller 1400.

The second compensation controller 1400 outputs second compensated image data by modifying first compensated image data or modified first compensated image data output by the variable dithering controller 820, based on a second compensation value. The second compensation value is a data compensation amount ΔData determined (or calculated) based on sensed data Dsen obtained by sensing a threshold voltage of a driving transistor.

The above-mentioned second compensation value may be an image data compensation value ΔData with which the difference in the threshold voltage between transistors in subpixels of the display panel 110 is compensated.

As described above, the timing controller 140 can provide not only the first compensation control operation and the VDC operation corresponding to stain compensation control, but also the second compensation control operation corresponding to threshold voltage compensation control.

The above-mentioned second compensation value may be an image data compensation value ΔData with which variations in the threshold voltage of transistors in subpixels of the display panel 110 are compensated.

Referring to FIG. 14, the variable dithering controller 820 compares the grayscale level corresponding to the second compensated image data, output through the second compensation control operation of the second compensation controller 1400, with the maximum grayscale level. When the grayscale level corresponding to the second compensated image data output through the second compensation control operation of the second compensation controller 1400 is equal to or smaller than the maximum grayscale level, the variable dithering controller 820 outputs the second compensated image data as it is. When the grayscale level corresponding to the second compensated image data is greater than the maximum grayscale level, the variable dithering controller 820 outputs modified second compensated image data by modifying the second image data such that the modified second compensated image data is equal to or smaller than the maximum grayscale level.

As described above, even if the possibility of an overflow is removed through the VDC operation in order to prevent pixel failure, the possibility of the overflow may occur again due to the second compensation control operation. In this case, it is possible to remove the possibility of the overflow by performing the VDC operation again for the second compensated image data corresponding to the result of the second compensation control operation.

Figure 15:
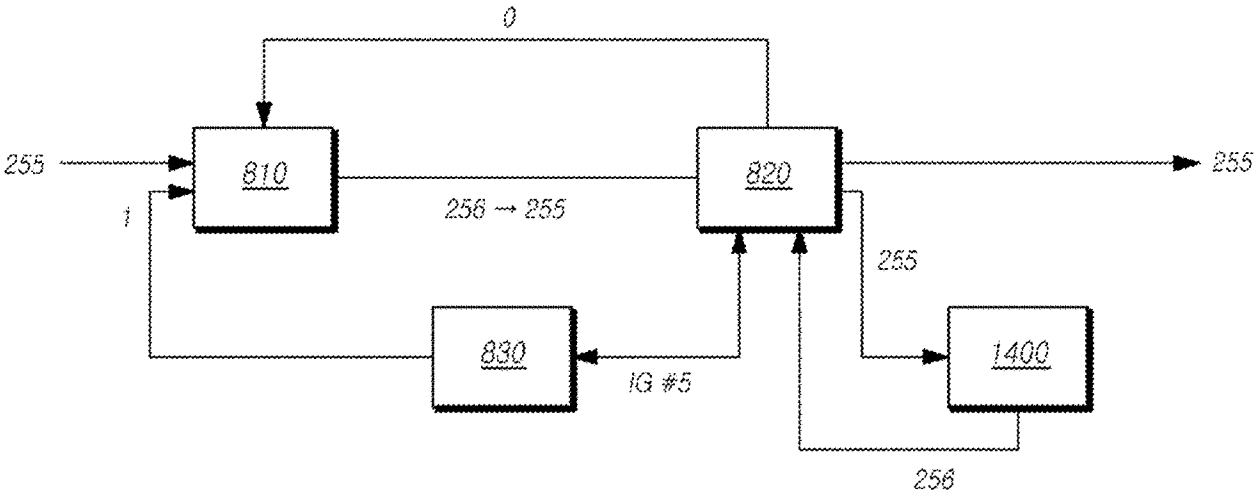
FIG. 15 is a block diagram illustrating a further exemplary VDC operation in the display device according to the present embodiments.

FIG. 15 is a block diagram illustrating a further exemplary VDC operation in the display device 100 according to the present embodiments.

In FIG. 15, it will be assumed that the maximum grayscale level, i.e., image data (WRGB data) having 255 gray level, of an 8-bit image signal are input to the first compensation controller 810.

Referring to FIG. 15, the first compensation controller 810 outputs first compensated image data corresponding to "256 gray level" by adding 255 gray level corresponding to image data and 1 gray level corresponding to a first compensation value of the image data.

Referring to FIG. 15, the variable dithering controller 820 determines whether or not the grayscale level of the first compensated image data is greater than the maximum grayscale level. Here, the maximum grayscale level is 255 level ($=2^8-1$).

Since the 256 gray level, the grayscale level of the first compensated image data, is greater than 255 gray level, the maximum grayscale level, the variable dithering controller 820 selects graph data corresponding to an interpolation graph among the plurality of interpolation graphs IG #1 to IG #6 saved in the memory 830 and determines a modified first compensation value. A value equal to or smaller than 255 gray level, the maximum grayscale level, is formed by adding the modified first compensation value to 255 gray level corresponding to the grayscale level of the image data.

Here, it is assumed that the interpolation graph IG #5 is selected among six interpolation graphs IG #1 to IG #6 illustrated in FIG. 9.

Referring to FIG. 15, the variable dithering controller 820 determines the first compensation value corresponding to 255 gray level, the grayscale level of the image data, by referring to the selected interpolation graph IG #5.

Referring to the interpolation graph IG #5 in FIG. 9, the first compensation value corresponding to 255 gray level is zero (0).

The variable dithering controller 820 sends the determined first compensation value 0 to the first compensation controller 810.

The first compensation controller 810 generates and outputs modified first compensated image data having 255 gray level by adding 0, the received first compensation value, to 255 gray level, the grayscale level of the image data.

Then, the variable dithering controller 820 outputs the modified first compensated image data by checking that 255 gray level, the grayscale level of the modified first compensated image data, is equal to or smaller than the maximum grayscale level (255 gray).

After the first compensation value is determined to be 0, the variable dithering controller 820 may not send the determined first compensation value to the first compensation controller 810, but may generate the modified first compensated image data by itself.

Afterwards, the second compensation controller 1400 receives the modified first compensated image data output from the variable dithering controller 820, and performs the second compensation control operation. Here, the second compensation value, the image data compensation amount ΔData, is assumed to be a value corresponding to 1 gray level.

Then, the second compensation controller 1400 outputs second compensation image data corresponding to 256 gray level to the variable dithering controller 820 by adding the second compensation value to the input first compensated image data (255 gray level+1 gray level).

Since the second compensated image data output from the second compensation controller 1400 corresponds to 256 gray level, the second compensated image data will cause an overflow when transferred to the corresponding source driver IC in this state. Then, the overflow may cause pixel failure.

To prevent such overflow, the variable dithering controller 820 modifies (compensates for) the second compensation image data output from the second compensation controller 1400 through VDC operation.

Specifically, when the grayscale level of the second compensated image data input from the second compensation controller 1400 is equal to or smaller than the maximum grayscale level, the variable dithering controller 820 outputs the second compensated image data as it is to the corresponding source driver IC. When the grayscale level of the second compensated image data input from the second compensation controller 1400 is greater than the maximum grayscale level, the variable dithering controller 820 outputs modified second compensated image data to the corresponding source driver IC by performing interpolation such that the grayscale level of the modified second compensated image data is equal to or smaller than the maximum grayscale level.

The variable dithering controller 820 may modify the second compensated image data to obtain the modified second compensated image data by referring to graph data corresponding to an interpolation graph selected among the plurality of interpolation graphs IG #1 to IG #6 saved in the memory 830, in the same manner as when modifying the first compensated image data to the modified first compensated image data.

When the image is represented using the modified second compensated image data output by the variable dithering controller 820, the area appearing to be a dark defect due to pixel failure, as illustrated in FIG. 5, can be obviated.

Hence, the VDC operation can prevent pixel failure.

Hereinafter, a method of driving the above-described OLED display device 100 will be described.

Figure 16:
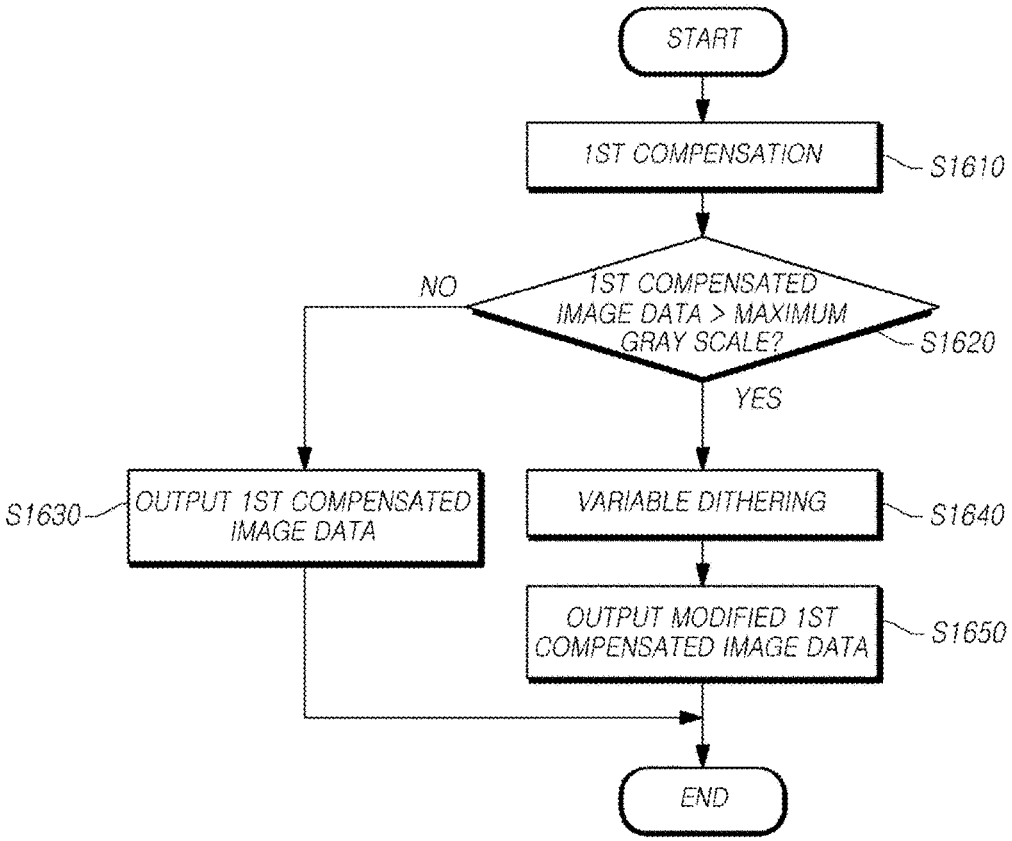
FIG. 16 is a flowchart illustrating a method of driving the OLED display device according to the present embodiments.

FIG. 16 is a flowchart illustrating the method of driving the above-described OLED display device 100 according to the present embodiments.

Referring to FIG. 16, the method of driving the display device 100 according to the present embodiments includes: first compensation operation S1610 of generating first compensated image data by adding a first compensation value to image data; first compensated image data outputting operation S1620 of outputting the first compensated image data when the first compensated image data is equal to or smaller than a maximum grayscale level; variable dithering operation S1640 of modifying the first compensated image data such that modified first compensated image data is equal to or smaller than the maximum grayscale level when the first compensated image data is greater than the maximum grayscale level; and modified first compensated image data outputting operation S1650 of outputting the modified first compensated image data obtained by modifying the first compensated image data.

The driving method as described above can be performed by the timing controller 140.

Through the above-described VDC operation, it is possible to prevent an image to be represented as first compensated image data exceeding the maximum grayscale level, thereby preventing pixel failure.

As described above, the present embodiments provide the timing controller 140, the display device 100, and the method of driving the same able to prevent a dark defect that would otherwise occur when two or more image control technologies are applied.

In addition, according to the present embodiments, it is possible to provide the timing controller 140, the display device 100, and the method of driving the same able to prevent a dark defect due to unexpected pixel failure when the stain compensation control operation and the dithering control operation are performed in a combined manner.

Furthermore, according to the present embodiments, it is possible to provide the timing controller 140, the display device 100, and the method of driving the same able to prevent a dark defect due to unexpected pixel failure when the stain compensation control operation, the dithering control operation, and the threshold voltage compensation control operation are performed in a combined manner.

The foregoing descriptions and the accompanying drawings have been presented in order to explain the certain principles of the present invention. A person skilled in the art to which the invention relates can make many modifications and variations by combining, dividing, substituting for, or changing the elements without departing from the principle of the invention. The foregoing embodiments disclosed herein shall be interpreted as illustrative only but not as limitative of the principle and scope of the invention. It should be understood that the scope of the invention shall be defined by the appended Claims and all of their equivalents fall within the scope of the invention.

What is claimed is:

1. A timing controller comprising:

a first compensation controller configured to generate first compensated image data by adding a first compensation value to image data according to a dithering pattern; and a variable dithering controller configured to:

output the first compensated image data, responsive to the first compensated image data generated by adding the first compensation value to the image data according to the dithering pattern being equal to or smaller than a maximum grayscale level, and generate modified first compensated image data by adding a modified first compensation value to the image data according to the dithering pattern such that the modified first compensated image data is equal to or smaller than the maximum grayscale level, responsive to the first compensated image data being greater than the maximum grayscale level, wherein the variable dithering controller outputs the first compensated image data or the modified first compensated image data which is equal to or smaller than the maximum grayscale level.

2. The timing controller according to claim 1, wherein the first compensation value comprises an image data compensation value in a predetermined first grayscale level area.

3. The timing controller according to claim 1, wherein the image data comprises RGB data or WRGB data converted from the RGB data.

4. The timing controller according to claim 1, further comprising a memory configured to save a plurality of sets of graph data describing a plurality of interpolation graphs that the variable dithering controller refers to when modifying the first compensated image data.

5. The timing controller according to claim 4, wherein, responsive to the first compensated image data being greater than the maximum grayscale level, the variable dithering controller is configured (i) to select interpolation graph data among the plurality of sets of graph data, the selected interpolation graph data corresponding to an interpolation graph causing the first compensated image data to be equal to or smaller than the maximum grayscale level, (ii) to determine the modified first compensation value by referring to the selected interpolation graph data, the modified first compensation value being added to the image data to produce the modified first compensated image data equal to or smaller than the maximum grayscale level, and (iii) to output the modified first compensated image data equal to or smaller than the maximum grayscale level, the modified first compensated image data being produced by adding the modified first compensation value to the image data.

6. The timing controller according to claim 5, wherein, responsive to the first compensated image data being greater than the maximum grayscale level, the variable dithering controller is configured to select interpolation graph data corresponding to an interpolation graph having a steeper gradient for a range of grayscale levels than a gradient of another interpolation graph used for generating the first compensated image data.

7. The timing controller according to claim 4, wherein the plurality of interpolation graphs indicate first compensation values for a range of grayscale levels, and have different gradients in a subset of the range of grayscale levels.

8. The timing controller according to claim 1, further comprising a second compensation controller configured to output the first compensated image data or second compensated image data by modifying the modified first compensated image data, based on a second compensation value.

9. The timing controller according to claim 8, wherein the variable dithering controller is configured to output the second compensated image data responsive to the second compensated image data being equal to or smaller than the maximum grayscale level, and to output modified second compensated image data by modifying the second compensated image data such that the modified second compensated image data is smaller than or equal to the maximum grayscale level responsive to the second compensated image data being greater than the maximum grayscale level.

10. The timing controller according to claim 8, wherein the second compensation value comprises an image data compensation value with which a difference in threshold voltages of transistors in subpixels is compensated.

11. A method of driving a display device comprising:

generating first compensated image data by adding a first compensation value to image data according to a dithering pattern;

outputting the first compensated image data generated by adding the first compensation value to the image data according to the dithering pattern responsive to the first compensated image data being smaller than or equal to a maximum grayscale level; and generating and outputting modified first compensated image data by adding a modified first compensation value to the image data according to the dithering pattern such that the modified first compensated image data is equal to or smaller than the maximum grayscale level responsive to the first compensated image data being greater than the maximum grayscale level, wherein the first compensated image data or the modified first compensated image data which is output is equal to or smaller than the maximum grayscale level.

12. A display device comprising:

a display panel comprising data lines, gate lines, and a matrix of subpixels disposed thereon;

a timing controller configured to generate output image data by modifying input image data based on a piece of variable dithering control data among a plurality of pieces of variable dithering control data variously defining compensation values for a range of grayscale levels, each of the plurality of pieces of variable dithering control data describing an interpolation graph of different compensation values for the range of grayscale levels; and a data driver electrically connected to the timing controller and the data lines, the data driver configured to:

receive the output image data, convert the output image data to data voltages, and output the data voltages to the data lines, wherein the output image data is equal to or smaller than a maximum grayscale level, and the output image data is generated by adding the compensation value to the input image data.

13. A display device comprising:

a display panel comprising data lines, gate lines, a matrix of subpixels disposed thereon;

a timing controller configured to:

generate compensated image data by modifying input image data according to a compensation value and a dithering pattern associated with the dithering pattern, determining whether the compensated image data generated by modifying the input image data according to the compensation value and the dithering pattern is larger than a maximum grayscale level, and generate output image data by adding a modified compensation value to the input image data according to determination of whether the compensated image data is larger than the maximum grayscale level; and a data driver electrically connected to the timing controller and the data lines, the data driver configured to convert the output image data into data voltages and to output the data voltages to the data lines, wherein subpixels to which the data voltages according to the image data corresponding to the maximum grayscale level are applied and a dark defect is not formed on the display panel.

14. The timing controller according to claim 7, wherein the plurality of interpolation graphs have different gradients at a common compensation value.

15. The timing controller according to claim 1, wherein the first compensation value is generated to compensate for a stain due to the image data.

16. The timing controller according to claim 1, wherein the modified first compensated image data is generated by adding a second compensation value to the image data according to another dithering pattern.

17. The method of claim 11, wherein the modified first compensated image data is generated by adding a second compensation value to the image data according to another dithering pattern.

18. The display device according to claim 12, wherein the output image data is generated by:

generating intermediate compensated image data by modifying the image data based on another piece of variable dithering control data, and determining whether the intermediate compensated image data is larger than a maximum grayscale level.

19. The display device according to claim 18, wherein the output image data is generated by modifying the input image data based on the piece of variable dithering control data, responsive to determining that the intermediate compensated image data is larger than the maximum grayscale level.

20. The display device according to claim 13, wherein the output image data is generated by modifying the input image data according to another compensation value and another dithering pattern, responsive to determining that the compensated image data is larger than the maximum gray scale level.

* * * * *